US006464599B1

(12) United States Patent
Wolf

(10) Patent No.: US 6,464,599 B1
(45) Date of Patent: Oct. 15, 2002

(54) GOLF CLUB PUTTER

(75) Inventor: Richmond A. Wolf, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/504,476

(22) Filed: Feb. 14, 2000

Related U.S. Application Data

(60) Provisional application No. 60/130,734, filed on Apr. 20, 1999, and provisional application No. 60/156,642, filed on Sep. 28, 1999.

(51) Int. Cl.[7] ..... A63B 53/04

(52) U.S. Cl. ..... 473/328; 473/340; 473/341; 473/349

(58) Field of Search ..... 473/238, 251, 473/256, 324, 313, 340, 334, 335, 336, 337, 339, 349, 350, 328, 288, 291, 341

(56) References Cited

U.S. PATENT DOCUMENTS

RE19,178 E * 5/1934 Spiker
3,333,854 A * 8/1967 White
3,419,275 A * 12/1968 Winkleman
4,529,202 A * 7/1985 Jacobson
5,013,041 A * 5/1991 Sun
5,211,401 A * 5/1993 Hainey
5,344,149 A * 9/1994 Miller
5,607,365 A * 3/1997 Wolf
5,704,851 A * 1/1998 Lucetti
5,769,738 A * 6/1998 Kershaw
5,961,399 A * 10/1999 Boyle

FOREIGN PATENT DOCUMENTS

WO 092015374 * 9/1992 ..... 273/173

* cited by examiner

*Primary Examiner*—Sebastiano Passaniti
(74) *Attorney, Agent, or Firm*—Fish & Richardson P.C.

(57) ABSTRACT

Golf club putter that has a raised center of gravity, to allow hitting a golf ball at an improved spot. The raised center of gravity is done by either changing the shape of the putter head, or the material layout of the putter head.

13 Claims, 8 Drawing Sheets

GOLF CLUB PUTTER

CROSS REFERENCE TO RELATED APPLICATIONS

This application claims the benefit of the U.S. Provisional Application No. 60/130,734, filed Apr. 20, 1999 and application Ser. No. 60/156,642, filed on Sept. 28, 1999.

FIELD OF THE INVENTION

The present-invention relates to improved putters with heightened center-of-gravity.

BACKGROUND AND SUMMARY

An important part of golfing is putting. Accurate putting requires attention to speed/distance and line. Speed/distance is controlled by the velocity and force applied to a ball, while line defines the direction of the moving ball. The line can only be made by the golfer, but the speed can be aided by a more consistent roll.

A top spin roll is generally most desired because it is less likely to be affected by bumps on the green which might otherwise effect the line of the ball. Many golf putter designs have attempted to aid the golfer in producing a moving ball that has an appropriate top spin roll.

It is an object of the invention to define a new design that facilitates this result.

Another problem with accuracy in putting is caused by ground interaction. A golfer usually lines up the putter with the ball ("at address"), brings the club back ("takeaway"), and then hits the ball and follows through. The desired results are obtained when the putter is kept exactly as the golfer intended it. However, the putter is usually touching the ground at address. During takeaway, the putter may interact with the ground ("ground interaction"). The golfer aims to keep the putter slightly above the ground during the rest of the takeaway and follow through. However, sometimes the putter does touch the ground. Even the most carefully manicured course includes some irregularities in its greens. This can affect the aiming of the putter, and hence effect the line of the ball.

In recognition of this problem, it is an object of another aspect of the present invention to reduce the amount of interaction between the club and the green. This is preferably done by reducing the surface area of the surface of the club that interacts with the ground, using a new technique.

It is often desirable to strike the golf ball near the center of gravity of the ball, i.e., its equator. The equator of a golf ball is usually around 0.75 inches off the ground, since a golf ball has a diameter of 1.5 inches. Another goal of the present invention is to aid the golfer in striking the ball at a consistent location.

The present invention features an improved golf putter which includes a pair of ground engaging surfaces attached to downwardly extending areas called herein runners. The runners include downwardly-extending feet which extend from the bottom surface of the putter head at the head's heel and toe. Each runner has a surface area which is less than the entire area of the bottom surface of the putter. The runner also has a height which depends on the shape and mass of the putter. The height can range from ⅛–⅝ inches.

During a stroke, this ground engaging surface becomes the lowermost area of the putter. If this surface does come into contact with the ground, the leading edge of the putter blade ("the blade") is raised to a level which is slightly below the ball's equator. Since any putter generally does not touch the ground during a putt, the ball will be struck with an upward blow during a putting stroke.

This action facilitates imparting the desirable top-spin roll to the golf ball.

The runners also facilitate the blade striking the ball at a location that minimizes undesirable side spin or back spin which otherwise occurs when the ball is putt.

The present invention defines improved structural aspects and surfaces which reduce the surface area that usually would come into contact with the ground. This thereby reduces the chance of ground interaction.

The base of the runners of the present invention have a reduced ground engaging surface area, thereby reducing their interaction with the ground. The runners have a smaller surface area than the head itself to minimize interaction with the ground. The combined surface area of each runner can be in the range of 0.15–0.35 $in^2$. The edge of the runners are preferably formed with a shape to further minimize interaction with the ground during a putting stroke, rounded, angled, or tapered.

The positions of the runners also allow the user to place or "set" the putter relative to the ball in a consistent, well-defined way. During the takeaway, the head is more consistently brought back and then moved forward along a straight path which is collinear with the desired path of the ball. This facilitates consistent, accurate putting.

As described above, a good putt involves proper speed and direction, including consistent speed and a desired direction from a straight takeaway and straight follow through. The present invention modifies speed by raising the blade, and modifies line by reducing the surface area.

Another aspect of the present invention uses an insert at the blade surface that is formed of a different material than the material of the remainder of the golf club. That material may, for example, have an elasticity which is similar to that of the covering of the golf ball (e.g., rubber or plastic). The insert makes it possible to strike the golf ball with a consistent force. The insert also produces a desirable "dead hit" which further facilitates accurate putting.

BRIEF DESCRIPTION OF THE DRAWINGS

These and other aspects of the present invention will now be described in detail with reference to the accompanying drawings, in which.

DETAILED DESCRIPTION

Figure 1A:
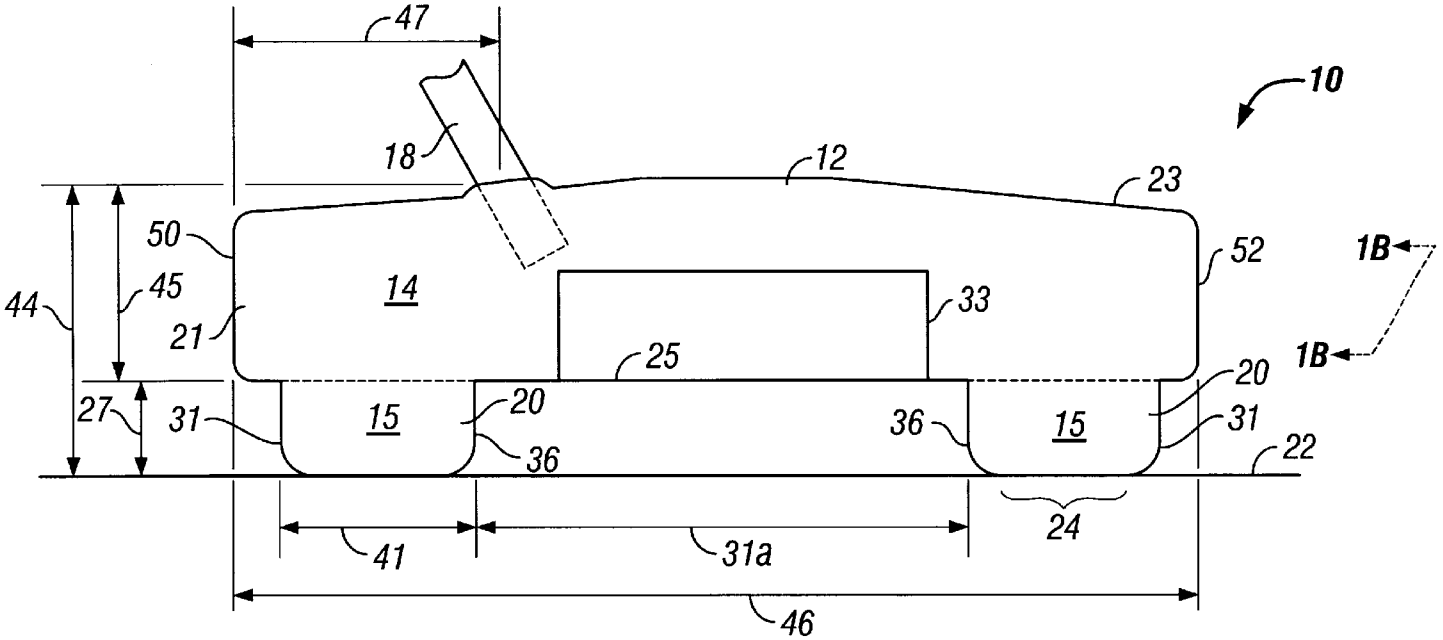
FIG. 1A is a front view of an improved putter according to the invention.
Figure 1B:
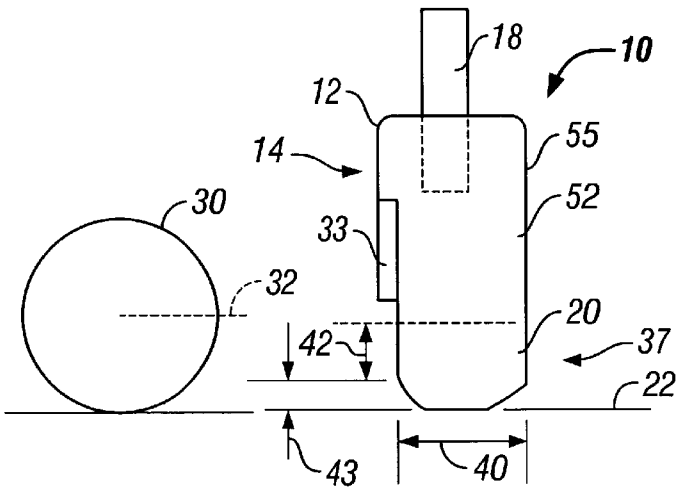
FIG. 1B is a side view of the putter of FIG. 1A prior to contact with a golf ball.

FIGS. 1A and 1B respectively show front and side views of a first embodiment of a putter 10 according to the invention. The putter 10 includes a head 12 having a front face 14, a shaft 18 which can include a handle or other elements allowing gripping the golf club, and a pair of runners 20, 21. Each runner includes a front portion 15 which faces the ball 30, and inside 36, outside 31, and back 37 portions. A ground engaging surface is formed from the lowermost surfaces of the runners in the general area 24.

The putter has a heel end 21 and a toe end 23. The first runner 20 is formed on the bottom surface of the head at the toe end 23 and the heel end 21. Blade 25 is formed on front face 14 between the runners 20 and 21.

The head 12 also includes side surfaces 50, 52 and rear surface 55, and a bottom surface 57.

The runners 20 and 21 raise the blade 25 of the putter 20 above a ground surface 22.

The surface area of the ground engaging surfaces of the runners (indicated by the bracket 24) which contacts the ground 22 is smaller than the surface area of the bottom surface 57 of the putter head 12. This system minimizes interaction between the blade and the ground during putting. The minimized interactions can reduce deflections of the putter. They also promote a firm top spin roll of the ball. The runners 20 and 21 also raise the blade 25 to a level which is slightly below the equator 32 of the ball 30 which allows more consistent putting pace which can contribute to speed. This helps the blade 25 to strike the ball 30 with an upward blow during putting. The upward blow imparts a desirable top-spin roll on the ball, and causes undesirable spin which tend to cause the ball to deviate from the desired path, such as back or side spins to be minimized.

The height and surface area of the runners are important design parameters in the putter head design. The height of the runner is shown as the arrow 27. This height determines the location where the ball is struck. A golfer usually raises the putter off the ground slightly during a putt. A putt begins with the bottom of the club head on the ground, but the putter is raised above the ground at the moment when it strikes the ball. The inventor found it desirable to form the runners to have a height which is below the equator of the ball.

The runners 20, 21 preferably have a height between ⅛ inch and ⅝ inches, with a height of 0.30 inches being the most preferred.

The total surface area of the runners is chosen to provide a stable base on which to set the putter while minimizing contact between the head and the ground. The preferred surface area is between 0.15–0.35 square inches per runner for a total of 0.3–0.7 square inches.

The distance separating the runners (shown by the arrow 31) is preferably wider than a golf ball diameter (1.5 inches). Preferably, this distance is between 1.2 and 2.5 inches. Other preferred dimensions of the putter are described herein with reference to the further embodiments.

Each runner preferably includes a straight segment (arrow 42) and a curved, tapered, or angled segment (arrow 43) along the front vertical portion which faces the ball. Sharp edges are less preferred, as they tend to catch on the ground during putting, thereby disrupting the swing. The back portion 37 of the runner is similar to the front portion, and includes a straight segment and a curved, tapered, or angled segment.

Insert 33 is shown on the front face 12. Insert 33 may be disposed between the two runners. As will become evident from investigation of the other embodiments, the insert is optional, and many usable embodiments omit using the insert.

The insert 33 includes a lower edge which is located even with the blade 25. The insert 33 is preferably formed of a material different than the material of the putter head 12.

Most preferably, the insert is formed of a material having some property which is similar to the material forming the outer covering of the golf ball. The insert 33 promotes a desirable "dead hit" when the ball is struck. Such a hit reduces vibrations during impact, minimizes the chances that the ball "jumps" off the front face of the putter head following impact, and, in general, provides the user with a more comfortable feel during putting.

The present invention preferably uses two runners. The putter is rested on the two runners prior to putting. During putting, the putter is easily drawn backwards from the rested position, and then pushed forward in a pendulum-type motion. The path along which the putter swings is generally collinear with the desired path of the ball. Conventional putters, in contrast, have a much larger bottom surface area. This creates a greater possibility that during takeaway or follow through that there may be risk of interaction with the ground. The present design is less likely to be thrown off line because there is less surface area interaction with the ground. Since the putter starts at rest on the ground and must be moved, interactions between the uneven ground and the putter surface must take place.

The inventor currently contemplates forming the putter of the present invention from the metallic glasses, as described in U.S. Pat. Nos 5,288,344 and 5,368,659.

Figure 2A:
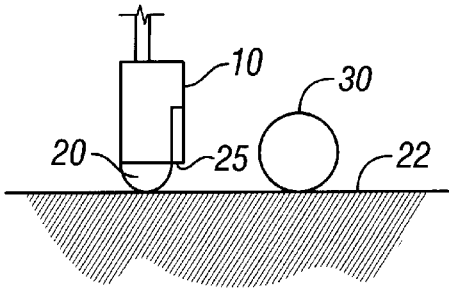
FIGS. 2A–2D are side views of the putter of FIG. 1A, respectively, prior to being swung, during swinging, immediately prior to contact with a golf ball, and immediately after contact with the golf ball.
Figure 2B:
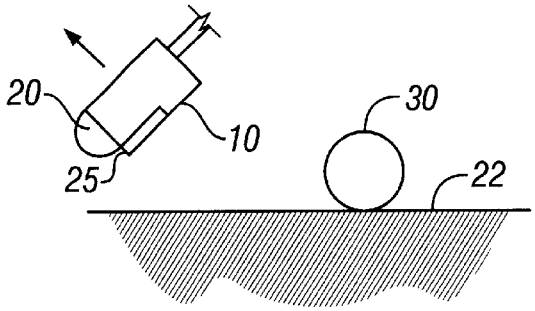
Figure 2C:
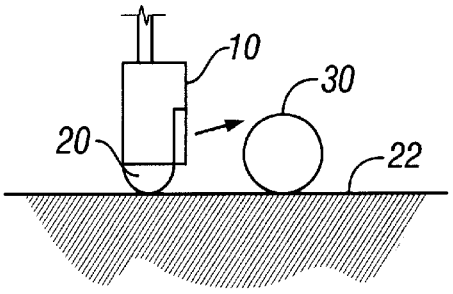
Figure 2D:
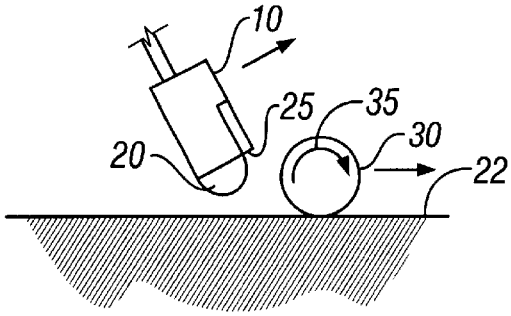

FIGS. 2A–2D show different positions of the putter 10 relative to a golf ball 30 during a putting stroke. Prior to the stroke (FIG. 2A) the putter 10 is set so that the runners 20 rest on the ground 22. The runners 20 elevate the blade 25 so that it is slightly below the ball's equator. The putter 10 is drawn back (FIG. 2B) and then pushed towards the ball. The bottom surfaces of the runners 20 are preferably above the ground 22 (FIG. 2C) as the ball is struck, if a good putting stoke is made. The blade 25 then impacts the ball 30 very near the ball's equator with an upward blow (FIG. 2D). This causes the ball to roll away from the putter with a desirable top spin (indicated by the arrow 35) and along a path collinear with a path defined by the putters swing.

Figure 3A:
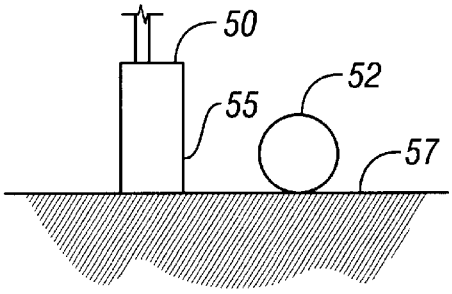
FIGS. 3A–3D are side views of a putter of the prior art, respectively, prior to being swung, during swinging, immediately prior to contact with a golf ball, and immediately after contact with the golf ball; and, FIGS. 4A–4C show another embodiment of the invention which includes rounded edges on the putter.
Figure 3B:
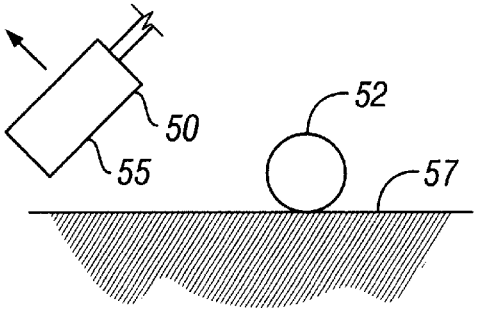
Figure 3C:
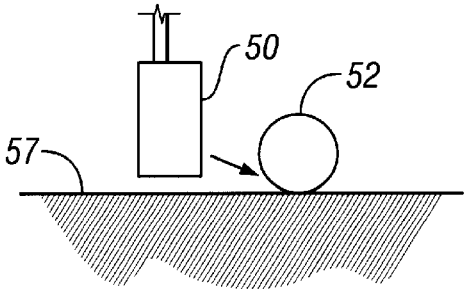
Figure 3D:
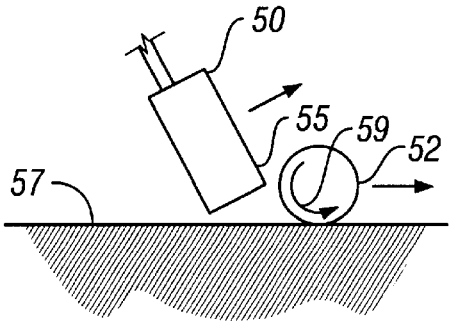
FIG. 3D (Prior Art)

FIGS. 3A–3D show an analogous sequence of steps for a putter 50 of the prior art. Prior to the stroke (FIG. 3A) the putter 50 preferably rests with its blade 55 even with or slightly above the ground 57. The blade 55 is typically just below the ball's equator. The putter 50 is then drawn back (FIG. 3B) and then pushed towards the ball (FIG. 3C). The blade impacts the ball with the leading edge below the equator of the ball with a downward force (FIG. 3D) to generate backspin on the ball (indicated in the figure by the arrow 59), causing the ball to skid. The ball may eventually exhibit a top-spin roll, although this typically occurs after the ball has skidded for some small distance and deviated from its intended course.

Other embodiments include additional features.

Figure 4B:
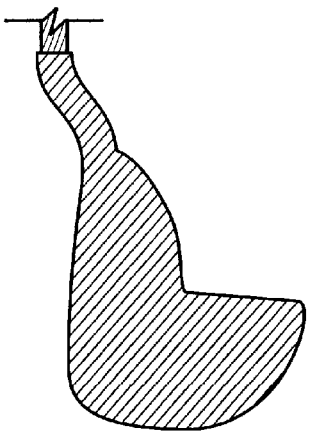
Figure 4A:
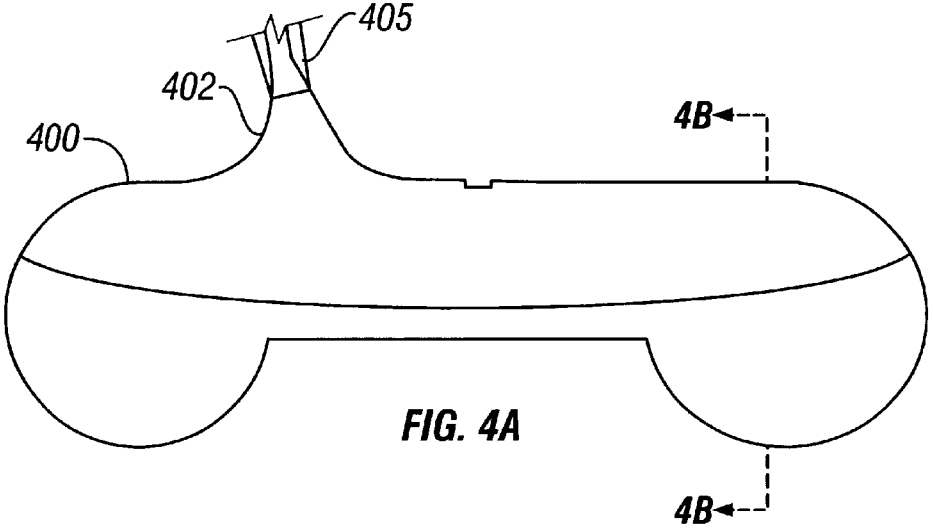
Figure 4C:
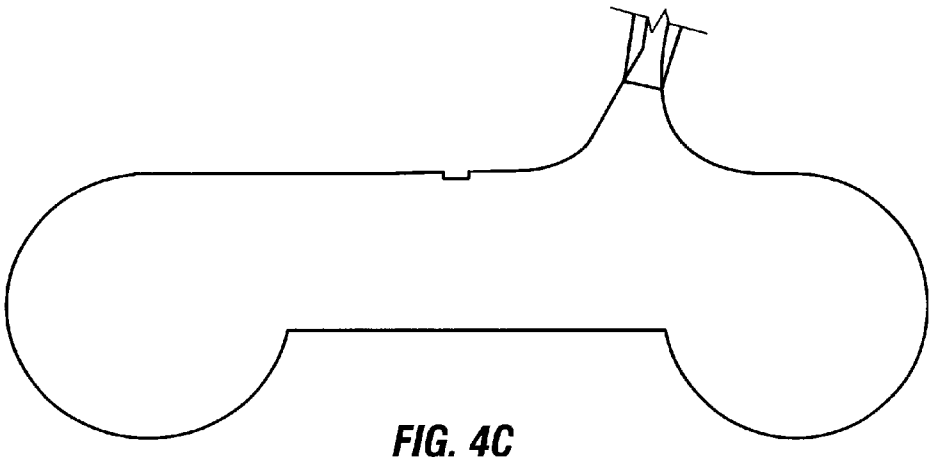

FIGS. 4A–4C show an embodiment that has a rounded head 400. The hozzle 402 of the head is sized to fit a shaft 405 around it. This embodiment includes a system which has no sharp edges on the putter—every edge is at least slightly rounded. The shaft fits around the outside of the hozel as shown.

The putter head 400 has a lower, runner area 410, which is wider in dimension than the upper, shaft attaching area 420. FIG. 4B shows a cross sectional view of the FIG. 4A rear view along the line 4B—4B. FIG. 4C shows the front view of the putter. The runners in this embodiment are rounded along multiple axes, to form a rounded ground engaging surface.

Figure 5A:
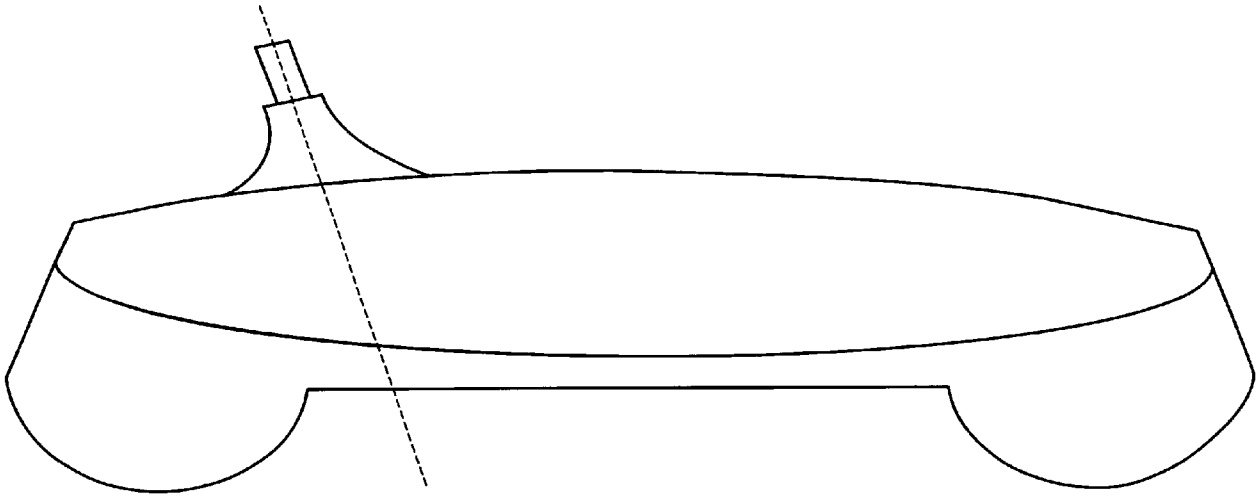
FIGS. 5A–5C show a rounded embodiment with a shaft that fits outside the putter neck.
Figure 5B:
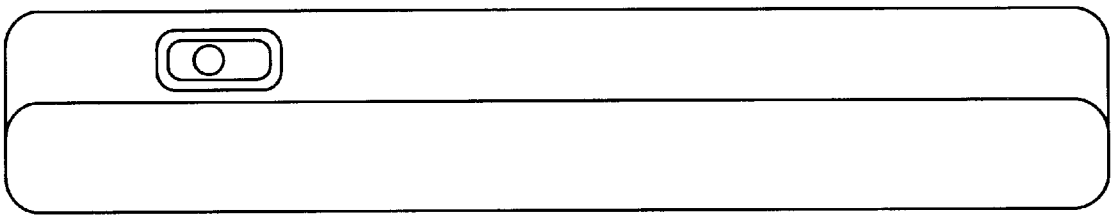
Figure 5C:
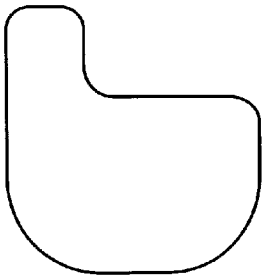

FIGS. 5A–5C show another rounded embodiment—this one having a shaft which fits around the outside of the neck of the putter. The preferred dimensions of this putter are 2.2 cm by 12.2 cm overall with a 1 cm lip forming the blade area.

Figure 6C:
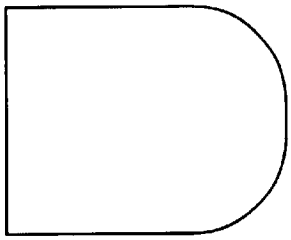
FIGS. 6A–6C show a crooked shaft putter embodiment.
Figure 6A:
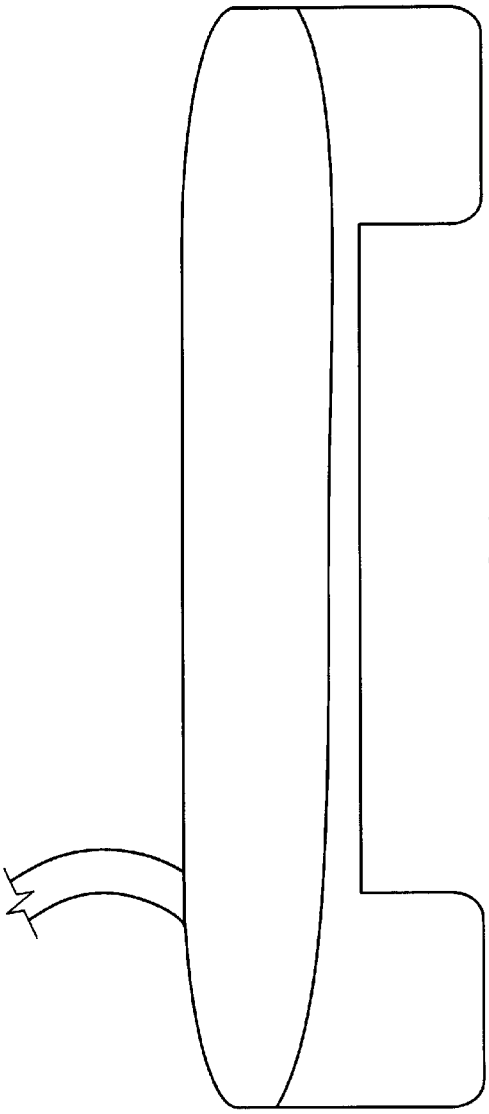
Figure 6B:
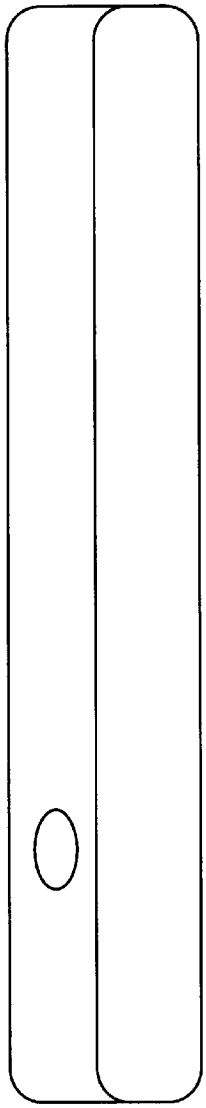

The FIGS. 6A–6C embodiment uses a crooked shaft.

Figure 7C:
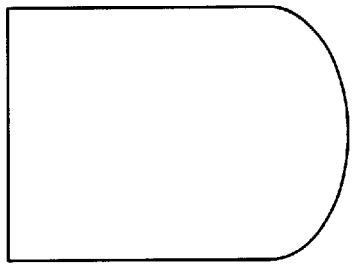
FIGS. 7A–7C show an embodiment including specially shaped runners.
Figure 7A:
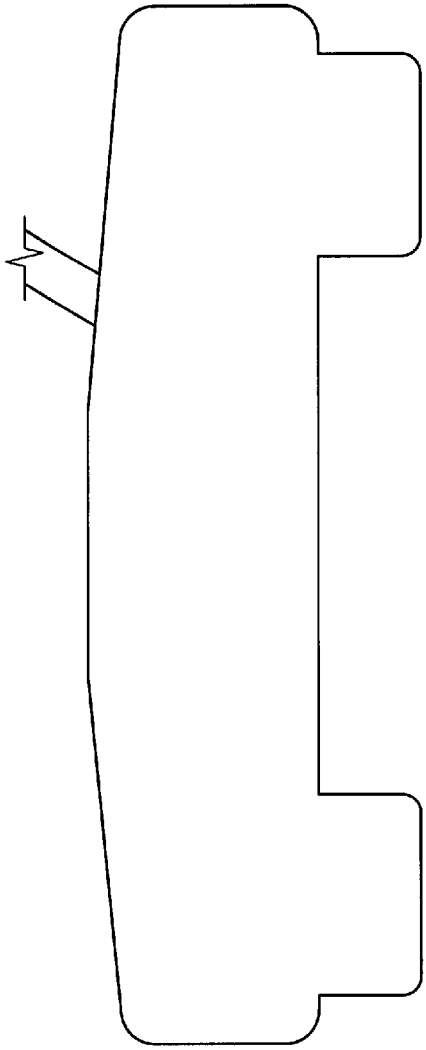
Figure 7B:
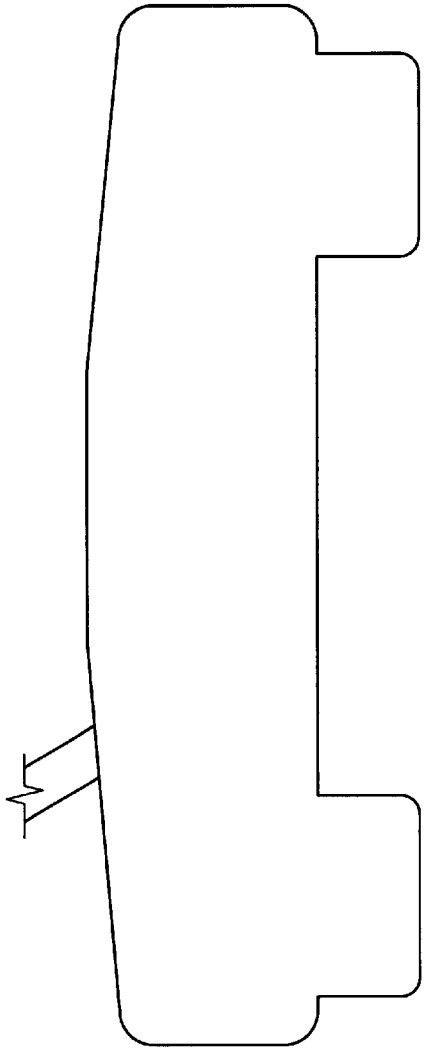

FIG. 7A–7C shows an embodiment with runners that are less rounded than those of previous embodiments.

Figure 8:
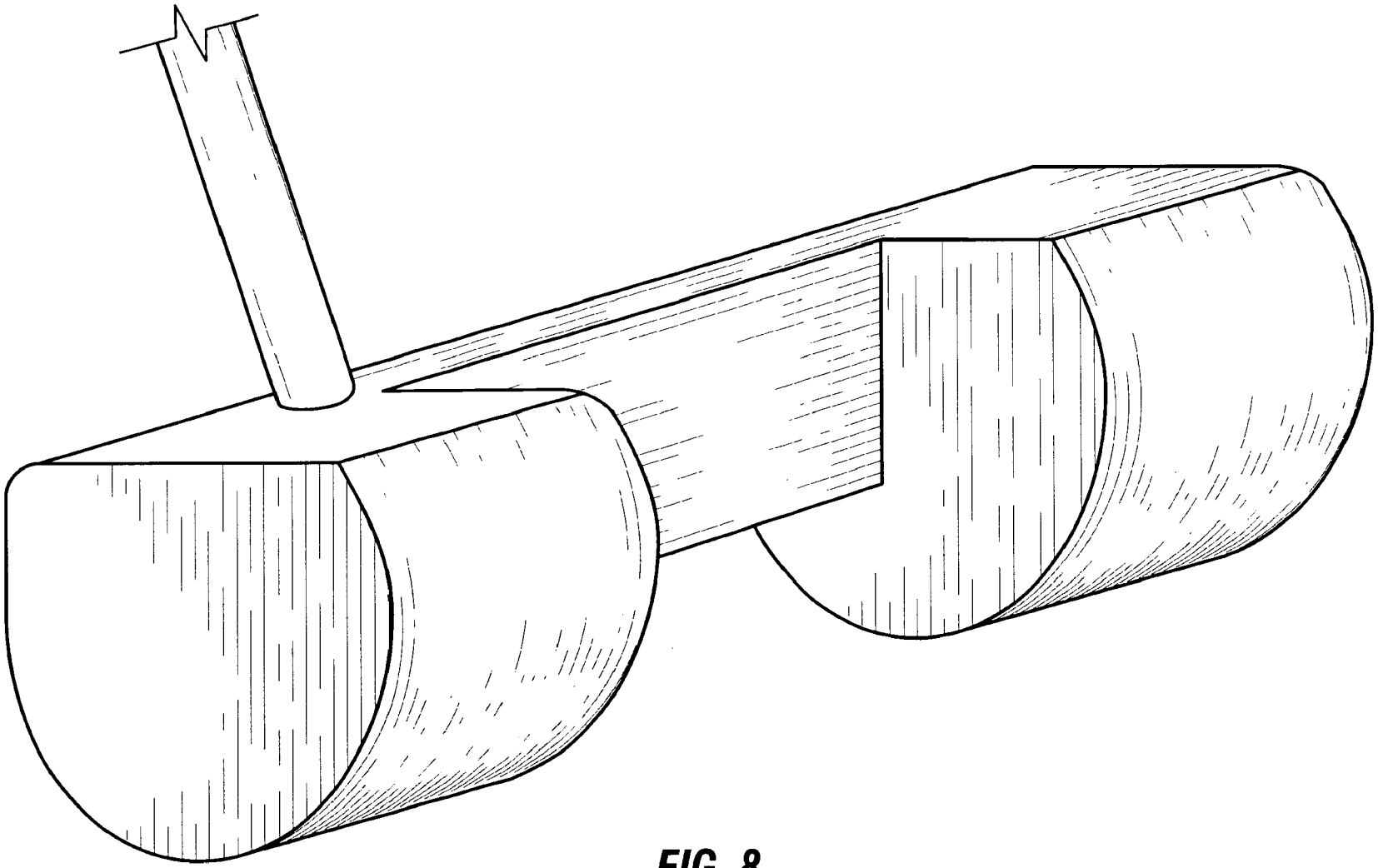
FIG. 8 shows an embodiment which is optimized for use with heavy material.

The FIG. 8 embodiment uses a special heavy material such as brass or bronze.

Other embodiments are within the scope of the invention. For example, runners can be included with any type of putter design. In addition, each dimension of the putter head depends on the types of materials used to fabricate the head. These dimensions can therefore be adjusted significantly for different types of putters formed from different materials. In particular, the dimensions are likely to decrease when more dense materials are used.

The runners described above have ellipsoidal cross sections. Alternatively, the runners can have triangular, cylindrical, circular, or any other type of cross-sectional area. The runners preferably include both flat and curved, angled, or tapered portions in all dimensions. For instance, all surfaces of the runner can be curved (e.g., the runner has a hemispherical shape).

The preferred embodiment of the invention features two runners. In other embodiments the putter can have a single runner. In this case, the runner has a similar shape as described above. In still other embodiments, the putter includes more than two runners, distributed periodically or randomly along its bottom surface.

Preferably, the putter head and the runners are formed together in a single cast. Alternatively, the runners can be attached to the putter head using, e.g., a weld or adhesive. Runners can be made on a putter having any shape or size which falls within guidelines of the United States Golf Association (USGA).

The angle of the putter's shaft has minimal affect on the design of the putter head and the runners. The shaft can be imbedded directly into the putter head.

The raising of center of gravity for most greater top spin of the golf ball while the previous embodiments have described one technique of raising center of gravity, additional techniques are described in the second and third embodiments described herein.

As above, raising the height of the blade can promote contact with the golf ball as close to the equator as possible. This also raises the center of mass in the putter to promote angular momentum that produces true roll. It creates a tendency to strike the ball with a leading edge to effect more consistent strikes without flyers. It also allows placing the blade flat on the putting surface. This provides for more consistent alignment of the putter blade and promotes a more consistent stroke.

When the blade meets the ball, all of the force vectors are resolved onto one point intersection between ball and blade. Underspin is generated when there is a component of force (or a resolved vector) that is oriented toward the putting surface. The type of spin should be a function of the direction of acceleration in which a putter approaches the ball, and also a function of the position of the center of mass with respect to the ball. To both promote a putting stroke with an upward force vector and position the mass in such a way as to generate more overspin and less underspin, the present embodiments raise the center of mass (C.O.M.).

FIG. 9A–9D show cross sectional views of a golf putter head of an embodiment that raises the center of gravity without the need for runners. In one embodiment, these features can be used without ground runners, i.e., they have a bottom-most surface that is substantially flat. Each of these heads has the common feature of a center of mass which is raised to a height above the center of the putter, and preferably above the center of the golf ball.

Figure 9A:
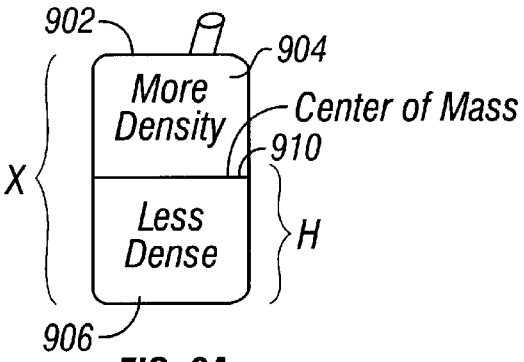
FIGS. 9A–9D show a number of different putter head designs.

FIG. 9A shows a golf club head which is substantially constant in cross-sectional area from its top area 900 to its bottom area 902. The golf club putter head is formed of two materials: a first more dense material area 904 formed of a first material and a second less dense material area 906 formed of a less dense material, and a separator 915 between the materials. Specific preferred materials are described in detail herein.

The center of mass 910 is defined by the density of the materials and the position of the separator 915 between the materials. According to this system, the center of mass is at a height H that is at least 55 percent of X where X is the total distance between the bottom surface of the bottom portion 902 and the top surface of the top portion 900. H is also approximately ¾ inch, or a little greater than ¾ inch.

In this embodiment, preferably the area of the head does not differ in cross section between its top and its bottom by more than 20 percent. The raised center of gravity is formed by a denser material rather than a changed cross-section.

Figure 10A:
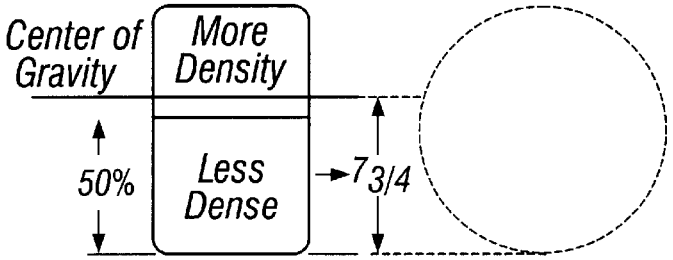
FIGS. 10A and 10B show a specific putter head design.

In one embodiment shown in FIG. 10A, the golf club head is formed of a lower half and a upper half. The density of the material of the upper half is preferably at least 5 percent more than the lower half.

The density (and hence mass) of the upper half of the golf club head in both FIGS. 9A and 10A is equal to between 105 percent and 170 percent of the density of the lower half. A value of 115 to 130 percent is optimal.

Exemplary materials are described herein. The denser materials (Group "H" materials) used on the top half 900 have a density greater than 6–7 grams/cc. Materials include, in order of denseness, stainless steel, copper alloy, such as copper beryllium, bronze, aluminum-bronze alloys, tungsten, lead, nickel, carbon steel, liquid metal, or regular steel.

The less dense materials (Group "L" materials) used in the lower portion 902 preferably have a density of less than 5 grams per cubic centimeter. These include, in order, wood, polymers such as Plexiglas (™) form of acrylic, liquid metal (U.S. Pat. No. 5,288,344) polydicyclopendadeyene (DCPD), carbon and carbon materials, aluminum, titanium, aluminum alloys, titanium alloys, and stainless steel.

As can be seen, the upper end of the less dense materials may overlap with the lower end of the more dense materials.

Figure 10B:
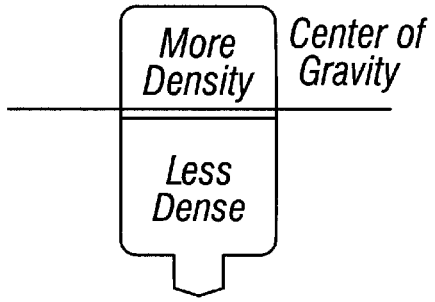

FIG. 10B shows this embodiment being coupled with ground runners as described with reference to FIGS. 1–8. Any of the ground runners can be used. In this embodiment, both altered center of gravity by materials, and by lifting the section itself, are combined. Again, H>=0.55×, and H>=¾ inch, the radius of a golf ball on the ground.

Figure 9B:
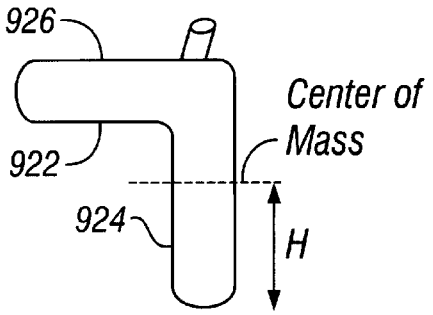

Another alternative for a golf club head shape is shown in FIG. 9B. In this embodiment, the golf club head is formed to have a non-uniform cross-section and formed of a homogeneous material. The golf club head 920 is formed with a top half of the golf club 922 that takes up a larger volume than the lower half 921 of the golf club head 924. The volume of the top is greater than the volume of the bottom by at least five percent. In this way, even though a homogeneous material is used, the relationship of H>=0.55× and H >=¾ inch is maintained. Again, preferably the mass of the top "half" of the head is between 105 percent and 170 percent of the mass of the bottom half, and more preferably 115 percent to 130 percent. The golf club head in FIG. 9B can be formed with a striking surface in area 924 and an overhanging portion 926 which overhangs the striking surface. The golf club head can be formed of any of the materials from groups A or B described previously. The head can also be formed with runners.

Figure 9C:
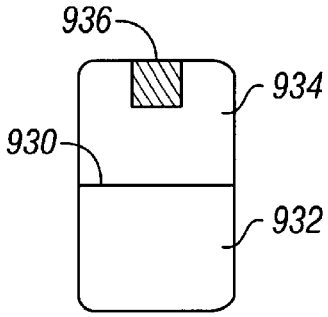

A third embodiment, shown in FIG. 9C, forms a golf club head 930 in any of the shapes described in any of FIGS. 1–9B, 9D or FIG. 10. The head can be formed of multiple materials, or formed of a single material and can be of any desired cross-section. The head is conceptually divided into top and bottom halves 932 and 934. The top half includes a strip 936 of a heavy weight material, such as lead. The heavy weight strip of material changes the weight balance of the top portion relative to the bottom portion. In this way, the top half is caused to have between 105 percent and 170 percent of the weight of the bottom half; more preferably between 115 percent and 130 percent. Again, this can be formed with runners as in FIG. 10B.

Figure 9D:
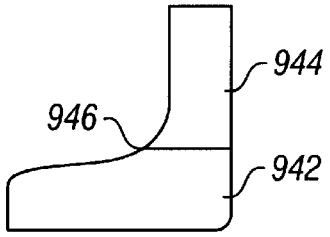

Another embodiment shown in FIG. 9D forms the golf club head with a bottom portion 942 that has a larger cross-section than the top portion 944. The material of the bottom portion 942 is a less dense material from the group L materials. The material of the top portion 944 is a more dense material e.g. selected from the group H materials. While FIG. 9D shows these materials being functionally divided at their halfway point, it should be understood that the dividing line 946 between the bottom portion 942 and the top portion 944 could be at any portion in between those two portions.

All such modifications are intended to be encompassed in the following claims.

What is claimed is:

1. A golf club putter, comprising:

a golf club head, having a striking surface and a connection for a golf club handle, said golf club head having a top portion which is at least between 105 percent and 170 percent the weight of the bottom portion, wherein said golf club head has a cross-section with an area difference that does not differ by more than 20 percent between said top and bottom portions.

2. A golf club as in claim 1 wherein said bottom portion is formed of a less dense material and said top portion is formed of a more dense material.

3. A golf club as in claim 2 wherein said more dense material is from group comprising stainless steel, copper alloy bronze, aluminum-bronze alloys, tungsten, lead, nickel, carbon steel, liquid metal, or regular steel and said more less material is from the group comprising wood, polymers, carbon and carbon materials, aluminum, titanium, aluminum alloys, titanium alloys, and stainless steel.

4. A device as in claim 3 wherein said less dense material is DCPD.

5. A golf club as in claim 3 wherein a mass of a top half of said golf club head is between 105 percent and 170 percent of a mass of a bottom half of said golf club head.

6. A golf club head as in claim 1 wherein said increased weight in said top portion is formed by replacing a material of at least part of said top portion with a high weight material.

7. A device as in claim 6 wherein said high weight material is lead.

8. A device as in claim 6 wherein said high weight material is a materials from the group consisting of stainless steel, copper alloy, bronze, aluminum-bronze alloys, tungsten, lead nickel, carbon steel, liquid metal, or regular steel.

9. A golf club putter, comprising:

a golf club head, having a striking surface and a connection for a golf club handle, said golf club head having a top portion which is at least between 105 percent and 170 percent the weight of the bottom portion, wherein said golf club is formed of a homogeneous material, wherein said homogeneous material has a cross-sectional area at its top portion which is larger than the cross-sectional area at its bottom portion, wherein said cross-section of said top portion overhangs a ball striking surface.

10. A golf club putter, comprising:

a golf club head, having a striking surface and a connection for a golf club handle, said golf club head having a top portion which is at least between 105 percent and 170 percent the weight of the bottom portion, wherein said golf club head is substantially constant in cross-sectional area, wherein said increased weight in said top portion is formed by replacing a material of at least part of said top portion with a high weight material.

11. A golf club putter, comprising:

a golf club head, having a striking surface and a connection for a golf club handle, said golf club head having a top portion which is at least between 105 percent and 170 percent the weight of the bottom portion, wherein said golf club is formed of a top portion and a bottom portion and wherein a bottom half of said golf club is formed of a material defining a greater volume than the top half of said golf club, but the top half of said golf club has a greater mass than the bottom half of said golf club.

12. A golf club putter, comprising:

a golf club head, having a striking surface, a connection for a golf club handle, and a rear surface, opposite said striking surface, said golf club head having a top portion which is at least between 105 percent and 170 percent of the weight of the bottom portion, and wherein said golf club head has a width extending from said striking surface to said rear surface which varies by less than 20 percent between a top of the golf club head and a bottom of the golf club head.

13. A golf club putter as in claim 12, wherein said width of said golf club head is substantially constant between said top and said bottom.

* * * * *